US006119907A

United States Patent [19]

Benjamin

[11] Patent Number: 6,119,907

[45] Date of Patent: Sep. 19, 2000

[54] SHOULDERARM GUN CASE CONVERTIBLE TO BELT PACK

[76] Inventor: Robert S. Benjamin, 240 Pavillion, Winnimucca, Nev. 89445

[21] Appl. No.: 09/125,000

[22] Filed: Jul. 30, 1998

[51] Int. Cl.[7] ..... F41C 23/02

[52] U.S. Cl. ..... 224/150; 224/586; 224/660; 224/683; 224/913

[58] Field of Search ..... 224/913, 922, 224/586, 660, 682, 683, 684, 150

[56] References Cited

U.S. PATENT DOCUMENTS

| | | | |
|---|---|---|---|
| 586,533 | 7/1897 | Gates | 224/660 |
| 873,140 | 12/1907 | Veliquette | 224/660 |
| 3,701,371 | 10/1972 | Stackhouse . | |
| 4,024,997 | 5/1977 | Kolpin . | |
| 4,756,456 | 7/1988 | Schauer . | |
| 4,760,944 | 8/1988 | Hughes . | |
| 4,957,231 | 9/1990 | Kalisher . | |
| 5,327,669 | 7/1994 | Lannan et al. . | |
| 5,397,040 | 3/1995 | Lee . | |
| 5,488,799 | 2/1996 | Hauschild . | |
| 5,619,819 | 4/1997 | Hauschild . | |
| 5,673,836 | 10/1997 | Bush . | |
| 5,718,363 | 2/1998 | Graves . | |

FOREIGN PATENT DOCUMENTS

| | | | |
|---|---|---|---|
| 1419803 | 10/1965 | France . | |
| 2356111 | 1/1978 | France | 224/913 |
| 250232 | 5/1948 | Switzerland . | |

*Primary Examiner*—Linda J. Sholl
*Attorney, Agent, or Firm*—Richard C. Litman

[57] ABSTRACT

A convertible shoulderarm case which allows a hunter to carry his gun and all other necessary equipment either over his shoulder using a sling, or in a suitcase-like manner using a handle. When the gun is removed, the gun case can be folded to convert to a waist pack, allowing the hunter to keep all of his equipment readily accessible.

14 Claims, 5 Drawing Sheets

SHOULDERARM GUN CASE CONVERTIBLE TO BELT PACK

BACKGROUND OF THE INVENTION

1. Field of the Invention

The present invention relates to gun cases. Specifically, the invention is a soft case for a rifle or shotgun which also serves to carry additional hunting gear. The case can be carried slung over the shoulder when it contains the gun, thereby freeing the hunter's hands. When the gun is removed, the case converts to a waist belt pack for carrying and accessing the other hunting gear.

2. Description of the Related Art

Outdoor sportsmen such as hunters and fisherman have always faced the problem of conveniently and comfortably carrying the necessary equipment while in the wilderness. Several past inventors have developed several different approaches for carrying this equipment. None of these inventors, however, have invented a complete carrying system for everything needed while hunting.

The most closely related inventions known to the current inventor are described in U.S. Pat. Nos. 5,488,799 and 5,619,819, both issued to Alan D. Hauschild. Both of the Hauschild patents describe the same invention: a fishing pole or gun case which wraps around the waist to form an accessory carrier when not in use. The case has a single fixed pocket hanging down in front of the belt, and one or more removable and adjustable pockets. It has a carrying handle allowing for suitcase-like carry.

The current invention has several features which are not present in Hauschild's invention. Hauschild's invention does not have a shoulder strap allowing for hands-free carry while climbing.

Additionally, Hauschild's invention limits freedom of movement by having the main pocket hang down in front of the user's legs. Hauschild does not disclose any means for carrying items which would normally attach to a belt, the use of a quick-release belt buckle to fasten the invention around the sportsman's waist for increased security over a hook and loop fastening, or a waist pack with the ability to be worn in any position on the waist.

French Pat. No. 1,419,803 appears to picture a case for a fishing rod having a shoulder strap. The case wraps around the waist when the fishing pole is removed.

Several inventors devised various waist packs for sportsmen. Examples include U.S. Pat. No. 4,957,231, issued to Sheila L. Kailsher, describing a waist belt with a plurality of pockets with loop hangers, intended to replace a tackle box; U.S. Pat. No. 5,397,040, issued to Jeffrey S. Lee, describing a waist pack having a plurality of generally rigid storage compartments for fishing gear; U.S. Pat. No. 5,718,363, issued to Gordon Groves, describing a belt having Velcro straps for carrying a rifle or shotgun horizontally; and Swiss Pat. No. 250,232, which appears to picture a belt with various pouches attached. None of these patents discloses a means for carrying a rifle or shotgun.

At least two inventors patented inventions for protecting a rifle or shotgun from wet weather while hunting. U.S. Pat. No. 3,701,371, issued to Robert H. Stackhouse, describes a light, flexible gun sleeve having openings allowing access to the gun's controls, so that the gun can be fired while within the sleeve.

U.S. Pat. No. 4,756,456, issued to Kent R. Schauer, describes a soft gun case having waterproof elastomeric grommets fitting over the stud posts of a rifle's sling swivels.

The rifle can be carried slung over the shoulder in the case, and the case quickly unzipped to use the rifle without totally separating the rifle and case. Neither patent discloses a means for carrying hunting Spear other than a gun.

U.S. Pat. No. 4,760,944, issued to Thomas E. Hughes, describes a sling having ends wrapped around a bow or rifle, and secured using Velcro. The patent does not disclose any means of carrying equipment other than a gun or bow.

At least two inventors developed storage devices intended to facilitate storage of hunting or fishing equipment. U.S. Pat. No. 4,024,997, issued to Ronald N. Kolpin, describes a gun case having openable loops for hanging the case from a clothes hanger. If a handgun case is used, it may also have a loop allowing it to be used as a holster. U.S. Pat. No. 5,327,669, issued to Edie Lanrnan et al., describes a roll-up carry and storage case for multiple fishing rods. The case comprises a row of triangular pockets dimensioned to accept a fishing pole with the reel and accessories attached. Neither patent discloses any means for carrying a gun or fishing pole, or carrying other hunting or fishing equipment.

U.S. Pat. No. 5,673,836, issued to Steven Roy Bush, describes an outdoor apparel system comprising a vest having storage pockets on the front panels, a backpack having straps passing under the front panels of the vest, various extra clothing for weather protection, and a small shelter. The patent dies not describe any means for carrying a gun in the hunting field.

None of the above inventions and patents, taken either singularly or in combination, is seen to describe the instant invention as claimed. Thus a convertible rifle/shotgun case and belt pack solving the aforementioned problems is desired.

SUMMARY OF THE INVENTION

The invention is a gun case which forms a complete carrying system for everything a hunter is likely to need while hunting. When the case contains a gun, it can be carried like a suitcase, or carried over the shoulder using a sling. Using the sling provides for hands-free carry while climbing or descending a steep slope. Pockets and nylon webbing attached to the case carry all of the additional gear the hunter needs. When the hunter reaches the location he intends to hunt, he can remove the rifle, and wrap the case around his waist without reorganizing the compartment's contents, thus forming a convenient, readily accessible waist belt pack for his equipment.

When used as a gun case, the invention resembles a standard soft zippered gun case. The case has a wide rear portion for the shoulder stock end of the gun, having sufficient width to accommodate a rifle having a telescopic sight. The main compartment's zipper is located at this end. The narrow muzzle end is long enough so that the case can accommodate a standard hunting shotgun, one of the longest of all modern sporting weapons.

The wide portion of the case includes three large pockets, each with a smaller flat pocket immediately behind it, and a strap of nylon webbing permanently secured to the case at one end, and secured with hook and loop fasteners at the other end. This nylon webbing strap can be used to carry anything having belt loops, such as an ammunition belt slide or a knife sheath, through which loops the strap is passed. The opposite side of the case has the shoulder strap, and a carrying handle is on top. The rear end of the case includes one component of mating halves of a quick release belt buckle.

A nylon web belt extends from the pockets to the front end of the case. Attached to this belt is the other component of the quick-release buckle. This portion of the buckle can slide along the belt to adjust the length of the waist pack formed by the case. The nylon web belt can also be used to carry items normally clipped to a belt, such as a two way radio.

To convert the gun case to a waist pack, the gun is removed, the front end of the case folded rearward onto the side opposite the pockets. The fold corresponds to the ultimate location of one component of the buckle, which can be slipped along the webbing to that point. The top portion of the case is then folded over the front end, securing it with hook and loop fasteners. The case can now be wrapped around the hunter's waist and the opposing ends of the buckle clasped. Converting the waist pack to a gun case is accomplished by reversing the procedure.

When wearing the waist pack with the buckle in front, the pockets will be on either side and to the rear, and the nylon strip and nylon web belt will be in front. If the hunter needs to gain access to a pocket, he can simply spin the belt around his waist.

Accordingly, it is a principal object of the invention to provide a gun case which converts to a waist pack, resulting in a convenient means of carrying all necessary equipment for a hunter while hunting.

It is another object of the invention to provide a means for keeping all of a hunter's equipment accessible while leaving the hands free.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a gun case which carries not only a rifle or shotgun, but also all other equipment that a hunter needs to carry while hunting. When the gun is removed from the case, the case can be folded and converted to a waist pack which keeps the equipment readily accessible.

Figure 1:
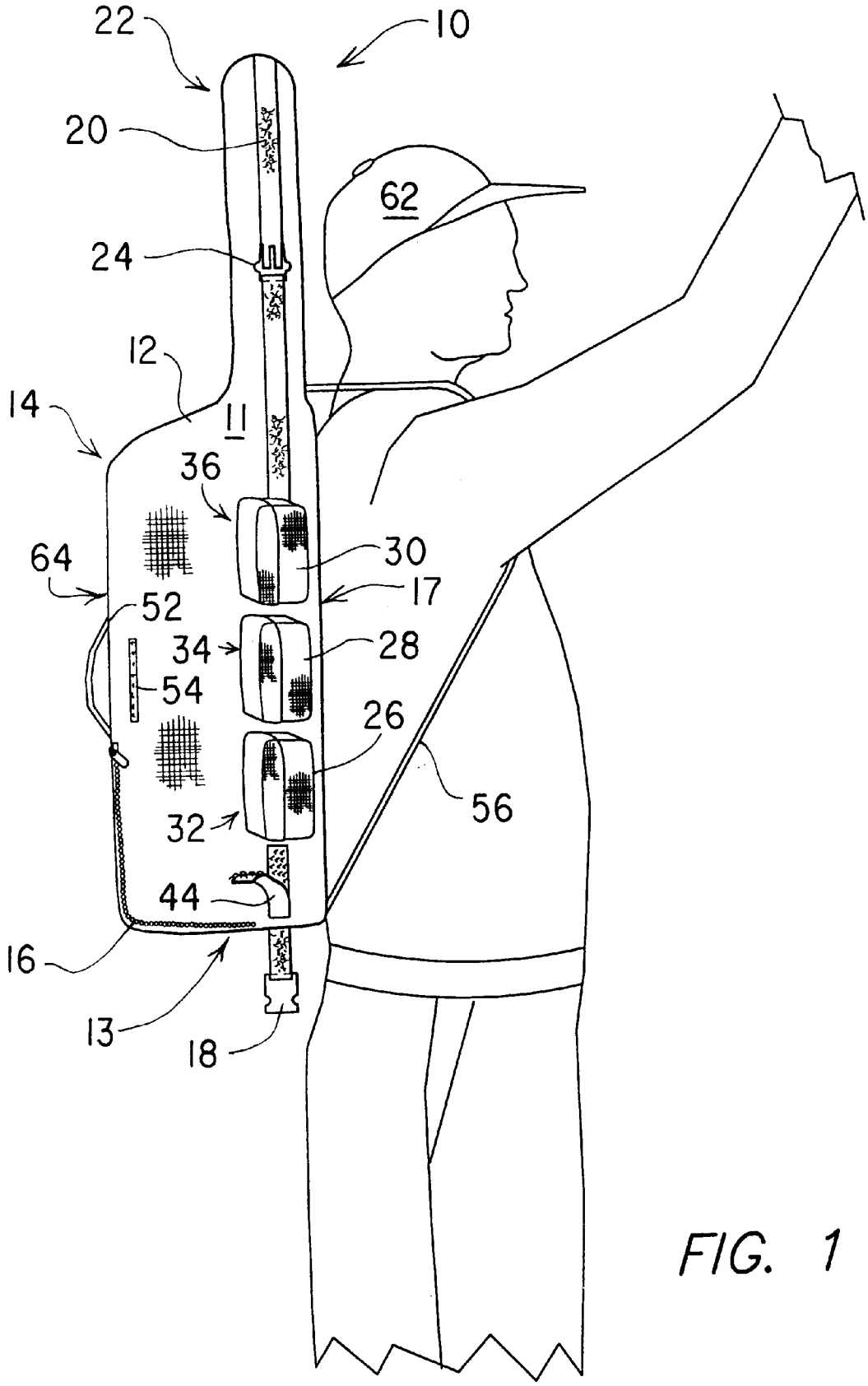
FIG. 1 is an environmental, side view of a convertible rifle/shotgun case according to the present invention, showing the gun case being carried by a sling over a hunter's shoulder.
Figure 2:
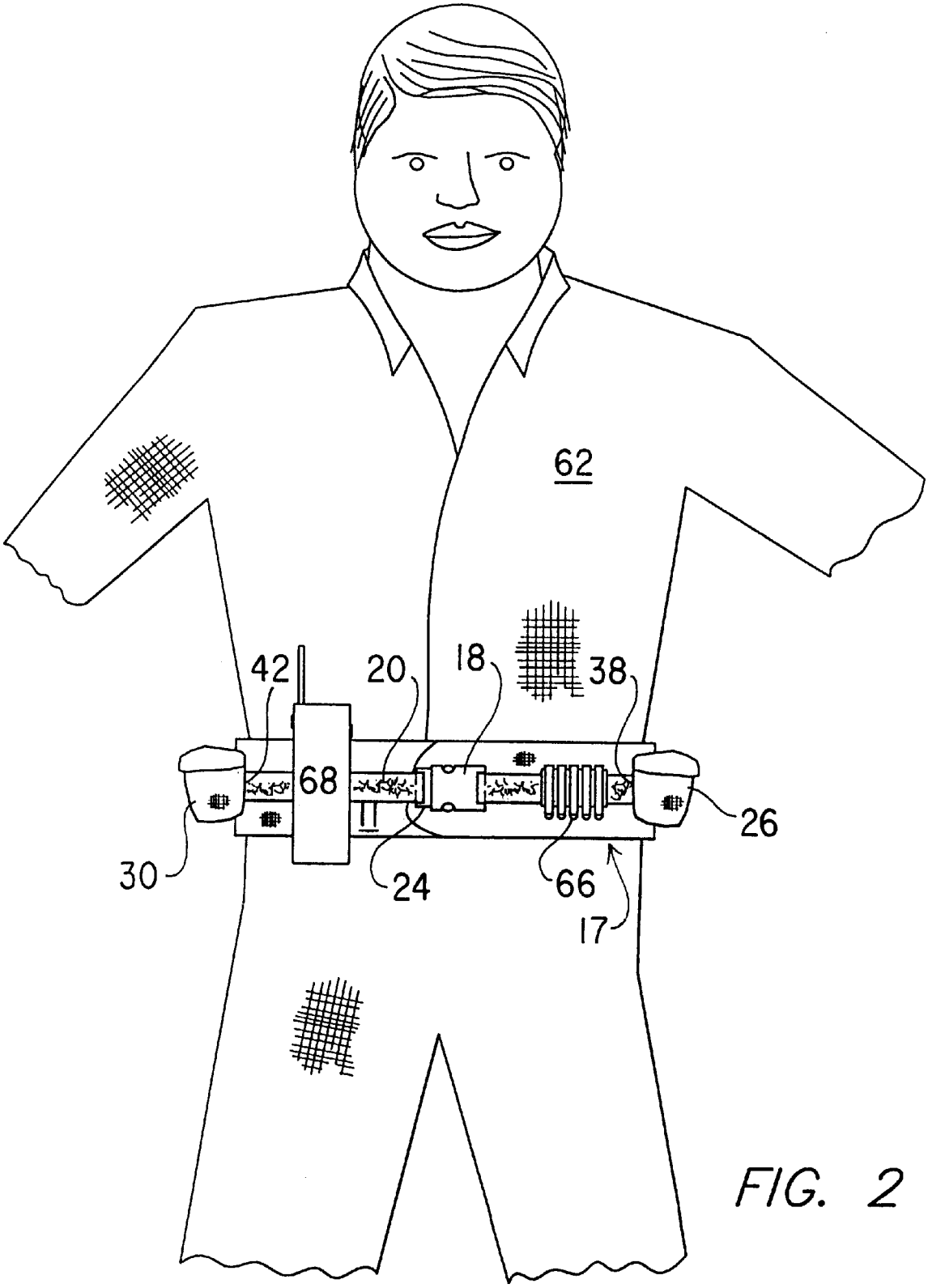
FIG. 2 is an environmental, front view of a convertible belt pack according to the present invention, showing the gun case being carried as a waist pack
Figure 3:
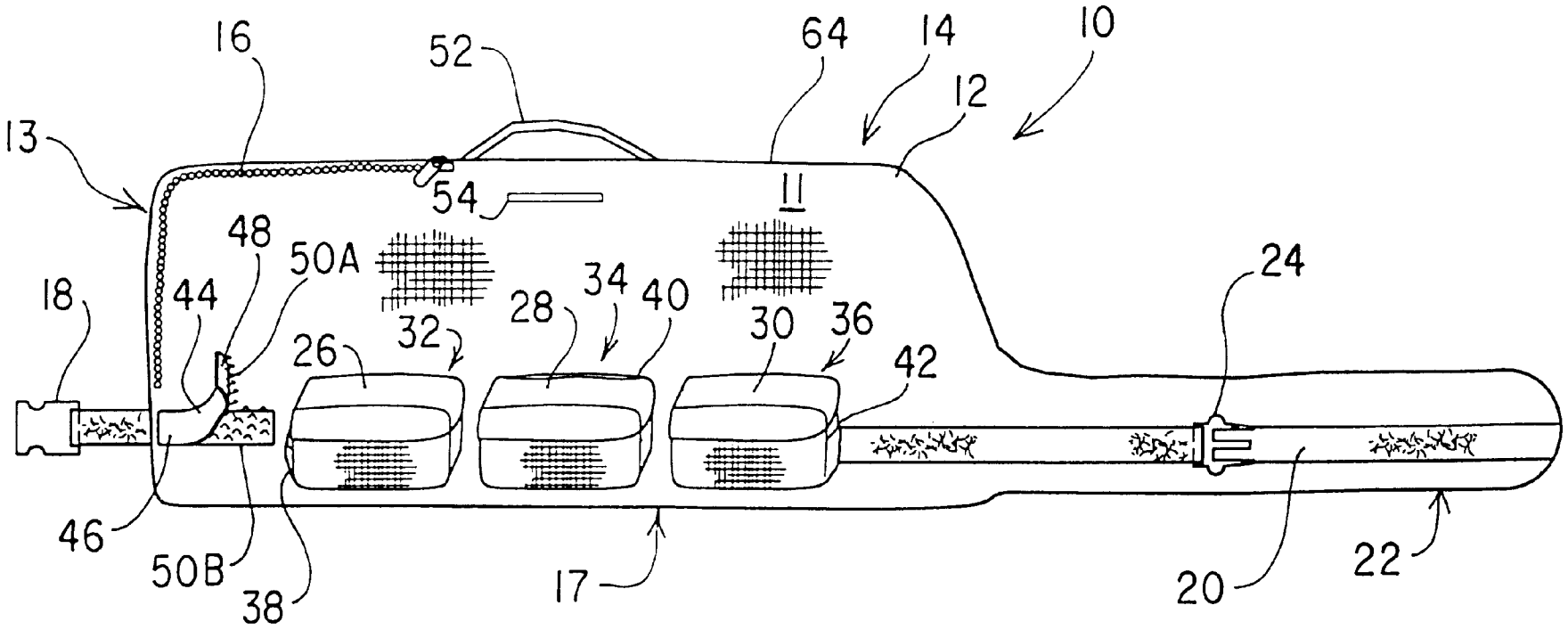
FIG. 3 is a side perspective view of a gun case according to the present invention, showing the outward side with the case unfolded for use transporting a gun.

Referring to FIGS. 1–3, the gun case 10 is oriented to show its outward side 11 (that side facing outward from the wearer when worn as a waist belt). The gun case 10 is made from fabric, which is flexible and may be water resistant. The case 10 is configured and designed around a main gun compartment 12, having a longitudinal axis following the axis of sight of a shoulderarm. The rear portion 14 of gun compartment 12 is relatively wide, having sufficient space to accommodate the shoulder stock and action portion of a rifle having a telescopic sight. The gun case is also long enough to hold a standard hunting shotgun, which are among the longest of modern sporting weapons. Ideally, gun compartment 12 is padded. Zipper 16 is located at the rear portion 14 of gun compartment 12, allowing access to the gun. Carrying handle 52, attached on a top portion 64 of rear portion 14, allows for suitcase-like carry of the case when used to carry a shoulderarm. Carrying handle 52 is preferably located above the center of gravity of a the case when the case contains a rifle or shotgun.

Nylon web strap 20 extends along the longitudinal axis across the front portion 22 of gun compartment 12, the strap 20 being attached at each end. A first end is attached proximate the muzzle end of the gun compartment 12 and the second end is attached proximate the integral junction of the rear portion 14 and the front portion 22. Male component 24 of the quick release buckle is slidably attached to nylon web strap 20. The gun case/waist pack 10 when worn as a waist belt can thereby be adjusted for different size waists by sliding male buckle component 24 along web strap 20.

The gun compartment's rear portion 14 along the outward side 11 includes three large pockets 26,28,30, generally aligned along the same longitudinal axis as web strap 20. Center large pocket 28 has flat pocket. 34 behind it, accessed through top opening 40. Side large pocket 26, has flat pocket 32 behind it, accessed through opening 38. Similarly, side large pocket 30 has side pocket 36 behind it, accessed through opening 42.

Female component 18 of the quick-release buckle is attached to the rear end 13 of gun compartment 12. Nylon web strap 44 is located between female buckle component 18 and side pocket 26, also along the longitudinal axis followed by web 20 and pockets 32,34,36. End 46 of web strap 44, adjacent to female buckle component 18, is permanently attached to gun compartment 12. End 48 of web strap 44, adjacent to side pocket 26, attaches by mating hook and loop fastener components 50a,50b attached to the web strap 44 and rear portion 14, respectively.

Figure 4:
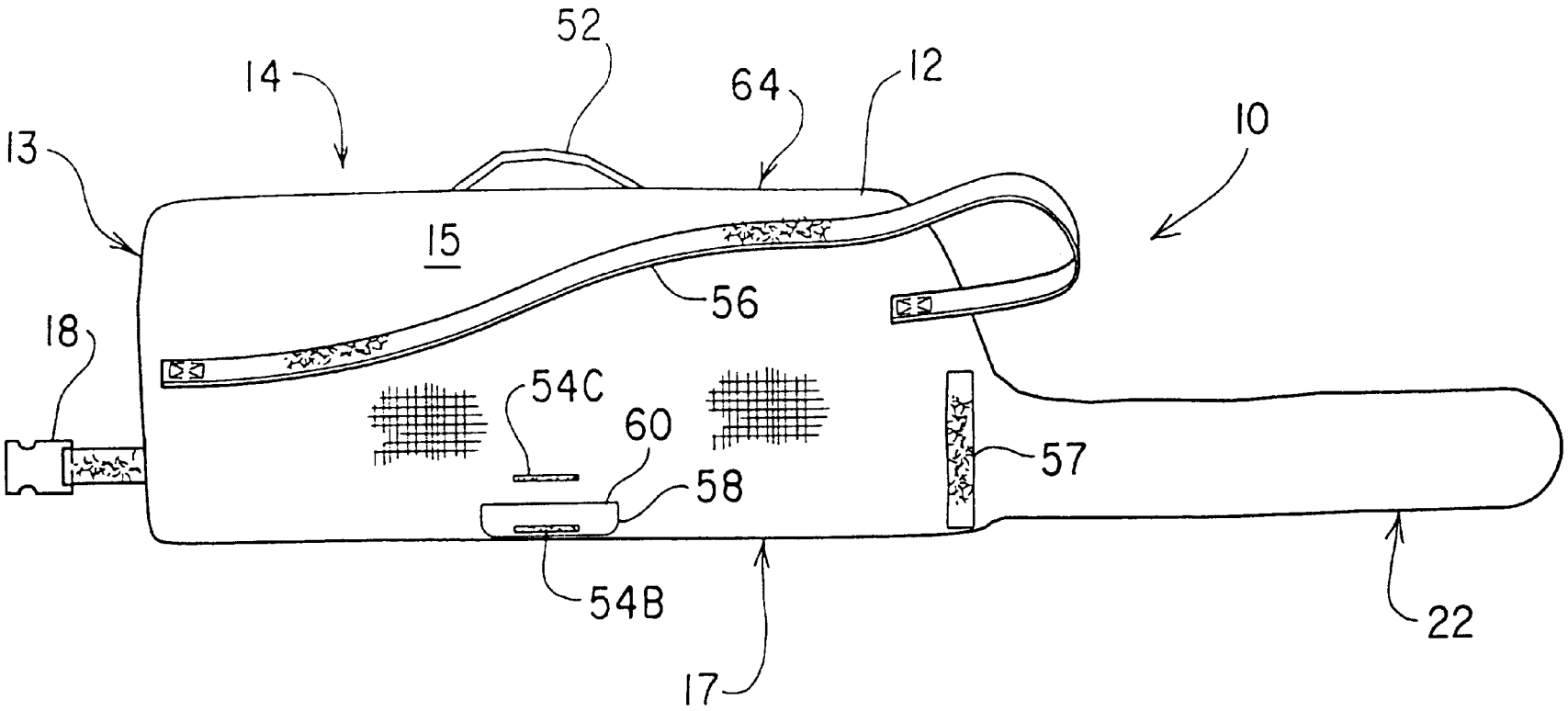
FIG. 4 is a side perspective view of a gun case according to the present invention, showing the inward side with the case unfolded for use transporting a gun.

Referring now to FIG. 4, an inward side 15 (that side facing the waist of a wearer when worn as a belt) of the gun case 10 includes shoulder strap 56, attached to the gun compartment's rear portion 14. Shoulder strap 56 is a nylon web attached between rear portion 14 and front portion 22 of gun compartment 12. As seen in FIG. 1, the gun case 10 is being used to transport a gun and other hunting equipment to the hunting location. Hunter 62 is using strap or sling 56 to carry the case, leaving his hands free to perform other functions, such as assisting with climbing or descending steep slopes. Pockets 26,28,30,32,34,36 are carrying additional equipment, eliminating the need to carry additional load bearing equipment.

Figure 5:
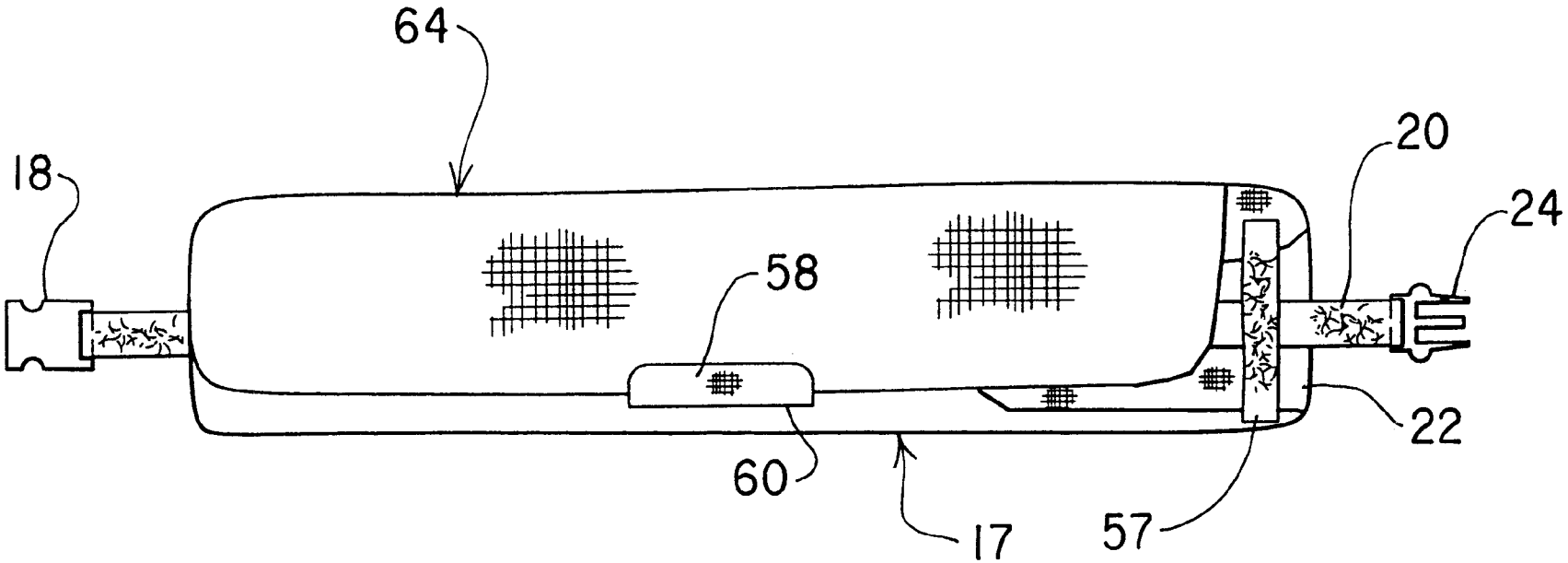
FIG. 5 is a side perspective view of a gun case according to the present invention, showing the inward side with the case folded for use as a waist pack.

Referring to FIGS. 3–5, the gun case 10 is easily converted into a waist pack. Several special components for conversion are provided on each of the outward and inward sides 11, 15 of the gun compartment 12. A loop 57 sized for receiving the front portion 22 is positioned near the junction of the rear portion 14 and the front portion 22 (FIG. 4). Flap 58, located near a bottom portion 17 of rear portion 14, is permanently attached to gun case 10 along side 60 (FIG. 4) The flap is secured by mating hook and loop components

54*b*, 54*c* secure the flap 58 against gun case 10. An auxiliary component 54 of a mating hook and loop fastener, chosen to mate with component 54*b*, is located adjacent to handle 52 at top portion 64 (FIG. 3 and 4).

The necessary positional relationships of these components can best be appreciated by describing the process of conversion. After removing the gun, front portion 22 is folded at the location of male buckle component 24 (which has been positioned for the proper waist size), and inserted through loop 57, thus shortening the gun compartment 12 to approximate the length of the rear portion 14. Top portion 64 is then folded towards flap 58, thus approximately bisecting the gun compartment along its longitudinal axis. Mating hook and loop components 54*b*, 54*c* are separated, and mating hook and loop components 54,54*b* are joined, thereby securing top portion 64 in position. Shoulder strap 56 and handle 52 are thus both enclosed within the folded rear portion 14, keeping both strap 56 and handle 52 from catching on vegetation or otherwise interfering with the activities of hunter 62. The gun case 10 is now ready for use as a waist pack.

FIG. 2 shows hunter 62 wearing gun case 10 as a waist pack. Pockets 26 and 30 are on either side of hunter 62, with pocket 28 (not visible in FIG. 2) being behind hunter 62. Nylon web strap 44 is being used to carry an ammunition belt slide 66. Additionally, a two way radio 68 can be clipped to nylon web belt 20. To gain access to pockets 28 and 34, which are behind the hunter 62 when mating buckle components 18,24 are in front, hunter 62 can merely spin gun case 10 around on his waist. In the preferred embodiment, the gun case will have a camouflage pattern. It may, however, be made in other colors.

It is to be understood that the present invention is not limited to the embodiment described above, but encompasses any and all embodiments within the scope of the following claims.

I claim:

1. A convertible shoulderarm case comprising:

a gun compartment having an outward side, an inward side, a front portion, a rear end, and a rear portion with a top portion and a bottom portion;

a plurality of pockets attached to said bottom portion of said rear portion along said outward side;

a belt extending from said pockets to said front end;

a buckle having two mating components, one of said mating components attached to said rear end of said gun compartment, and the other of said mating components being slidably attached to said belt;

a shoulder strap attached to said gun compartment;

first attachment means for removably securing said gun compartment so that said front portion is adjacent to said rear portion and for securing said front portion's inner side to said rear portion's inner side; and, second attachment means for removably securing said rear portion of said gun compartment so that said top is adjacent to said bottom.

2. The convertible shoulderarm case according to claim 1, further comprising a handle on said top portion of said rear portion.

3. The convertible shoulderarm case according to claim 2, wherein compartment has a center of gravity when it contains a gun and said handle is located above said center of gravity.

4. The convertible shoulderarm case according to claim 2, wherein said handle is positionally suited to being enclosed between said top portion of said rear portion and said bottom portion of said rear portion when said rear portion is folded so that whereby said top portion and said bottom portion are adjacent.

5. The convertible shoulderarm case according to claim 1, wherein said first attachment means is a loop attached to said rear portion.

6. The convertible shoulderarm case according to claim 1, wherein said second attachment means is mating components of hook and loop fasteners.

7. The convertible shoulderarm case according to claim 6, wherein one of said mating components of hook and loop fasteners is attached to a flap on said bottom portion of said rear portion.

8. The convertible shoulderarm case according to claim 1, further comprising a strap having a first end and a second end, said first end permanently secured to said gun compartment, and said second end secured to said gun compartment by hook and loop fasteners.

9. The convertible shoulderarm case according to claim 1, wherein said rear portion is dimensionally suited to containing the shoulder stock, action, and telescopic sight of a rifle.

10. The convertible shoulderarm case according to claim 1, wherein said gun compartment is dimensionally suited to containing a shotgun.

11. The convertible shoulderarm case according to claim 1, wherein said gun compartment is padded.

12. The convertible shoulderarm case according to claim 1, wherein said case is made from water resistant fabric.

13. The convertible shoulderarm case according to claim 1, wherein said case has a camouflage color pattern.

14. The convertible shoulderarm case according to claim 1, wherein said shoulder strap is positionally suited to being enclosed between said top portion of said rear portion and said bottom portion of said rear portion when said rear portion is folded for use as a belt pack.

* * * * *